US005082286A

United States Patent [19]

Ryan et al.

[11] Patent Number: 5,082,286

[45] Date of Patent: Jan. 21, 1992

[54] SENSORY GAMES

[75] Inventors: Paul Ryan, Cambridge, England; Eric K. Y. Tse; Carlo K. L. Lo, both of Hong Kong, Hong Kong

[73] Assignee: Saitek Limited, Kowloon, Hong Kong

[21] Appl. No.: 578,833

[22] Filed: Sep. 6, 1990

[30] Foreign Application Priority Data

Sep. 7, 1989 [GB] United Kingdom ..... 8920204

[51] Int. Cl.[5] ..... A63F 3/02

[52] U.S. Cl. ..... 273/238; 273/239

[58] Field of Search ..... 273/238, 239, 237

[56] References Cited

U.S. PATENT DOCUMENTS

| | | | |
|---|---|---|---|
| 3,683,363 | 8/1972 | Khlebutin | 273/238 X |
| 3,843,132 | 10/1974 | Ferguson | 273/238 |
| 4,299,389 | 11/1981 | Miolo | 273/239 |
| 4,343,609 | 8/1982 | Cardinal | 273/238 X |
| 4,391,447 | 7/1983 | Dudley | 273/238 |
| 4,545,582 | 10/1985 | Andrews | 273/238 |
| 4,981,300 | 1/1991 | Winkler | 273/238 |

FOREIGN PATENT DOCUMENTS

| | | | |
|---|---|---|---|
| 2103943 | 3/1983 | United Kingdom | 273/238 |

*Primary Examiner*—William H. Grieb

*Attorney, Agent, or Firm*—Townsend and Townsend

[57] ABSTRACT

Electronic game apparatus comprising a board displaying discrete playing areas and a number of playing pieces. Transmit and receive coils are provided beneath the surface of the board, preferably at right angles to each other, and each playing piece is provided in its base with an element. Means are provided for supplying a high-frequency current to each transmit coil in turn and for detecting the voltage induced in the receive coils for each discrete playing area. The presence of a playing piece on the playing area being tested, will affect the voltage induced in the receive coils and hence the presence, absence or type if desired, of a playing piece may be determined. The element preferably consists of any suitable metal or ferromagnetic material. Playing pieces of different types may be provided with elements of different materials.

10 Claims, 7 Drawing Sheets

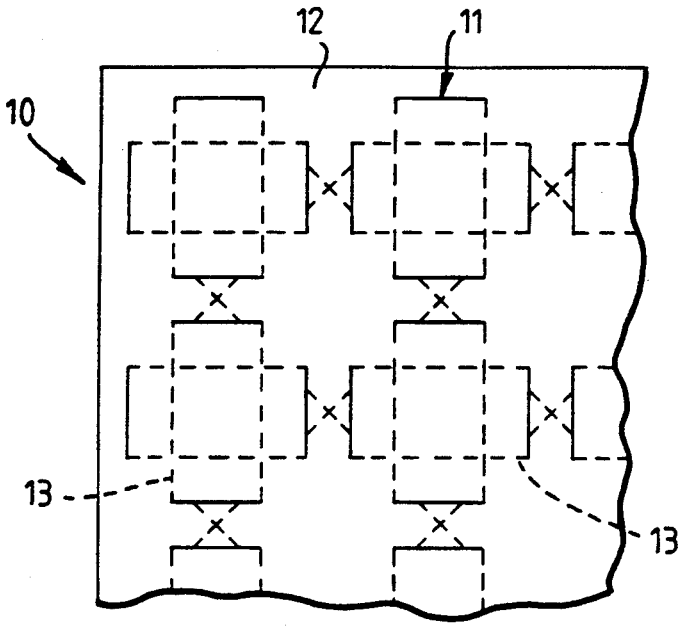
Fig. 5.
Fig. 6.
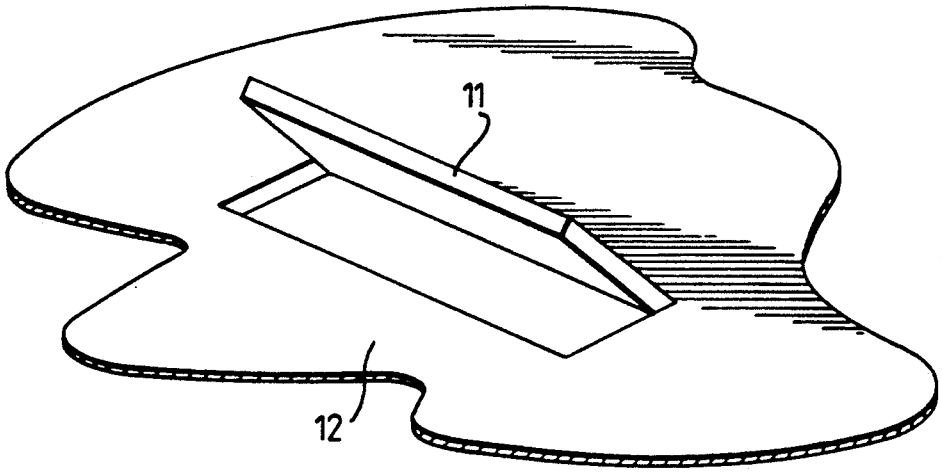

SENSORY GAMES

BACKGROUND OF THE INVENTION

This invention relates to sensory games and more particularly to the detection of the presence of playing pieces on a game board.

Most electronic games with 'presence sensor' systems, for example chess, use reed switches and magnets to track the moves of playing pieces on the game board. These games usually have one reed switch placed under each playing square and a magnet placed in the base of each playing piece. When a piece is placed on a square, the reed switch is activated and remains closed until the piece is removed. Thus, the progress of the pieces on the game board may be tracked by electronics if the pieces start from pre-defined positions e.g. a new game or a set-up position.

BRIEF SUMMARY OF THE INVENTION

The present invention uses the phenomenon of inductance between wires. When an alternating current is passed along one wire or coil, a voltage is induced in a neighbouring wire or coil due to the mutual coupling that occurs. This coupling is affected by the presence of material near to the area of overlap of the two wires. If a disc of highly conductive metal partly covers this area, the induced voltage is altered. The change is significant if the disc is parallel to the plane of and close to the coils and also covers an appreciable fraction of the overlapping area.

The sensing range of the board is proportional to the size of the overlap area between the two coils. The overlap should not be too great since the base of a playing piece would then only cover a small fraction of the overlap area.

The present invention is directed at a sensory game in which inductance between two sets of coils is used to determine the presence of a playing piece on a square, or the like, of a game board. The two sets of coils are situated near to the playing surface of the board and a high frequency current is supplied in turn to each of the coils of one set (the transmit coils), the high frequency current mutually coupling with the coils of the other set (the receive coils) and inducing a voltage therein. An element is provided in the base of each playing piece, the proximity of the base of a playing piece to the coils affecting the degree of mutual coupling between the coils and hence affecting the induced voltage. The voltage induced in each receive coil is compared to a reference to determine the level of change in voltage and hence the presence of a playing piece on each individual square. The reference is conveniently the voltage measured in the absence of any pieces on the board. This means that the effects of other metal close to the playing surface (e.g. the batteries) can be compensated for and that production tolerances may be relaxed.

A disc of highly conductive metal, for example aluminium, copper brass or iron, will cause the mutual inductance between the coils to decrease. The eddy current induced in the aluminium disc causes the disc to act like a "shield" to the magnetic field, so reducing the amount of coupling between the coils. On the other hand a disc of finely divided magnetic material, for example ferrite, will cause the mutual inductance between the coils to increase. No significant eddy currents are induced in the ferrite disc, the field is concentrated and hence the amount of coupling between the coils is increased.

All the playing pieces of the game apparatus may be provided either with an element, for instance, in the form of a disc, which increases the amount of coupling or with an element which decreases the amount of coupling. Alternatively, playing pieces of one type may be provided with a disc which increases the amount of coupling whilst playing pieces of a different type may be provided with discs which decrease the coupling. The latter embodiment means that it is possible to differentiate between the different types of playing pieces, as well as detecting the presence of a playing piece on a playing square.

It is particularly advantageous to be able to differentiate between the types of playing pieces when the game involves one type of playing piece replacing another on a playing area, for example in the game of chess when a playing piece of one type takes a playing piece of another. If the playing pieces of each type are identical, the apparatus may not sense such a move, which may involve a playing piece of one type being slid across a playing surface to push a playing piece of another type off a playing area. If the sensing range of the apparatus is relatively large, the system may continually see a playing piece on the playing area, even though a piece of one type has been replaced by a piece of another type. Having different materials in the bases of different types of pieces will overcome this problem, since the playing piece is seen to change, for example from black to white. Additionally, the different discs have opposite effects on the magnetic field, and therefore may cancel each other out in a sliding take.

Alternatively, in order to detect such a sliding move without distinguishing between piece types, the centre portion of the discs in each playing piece may be removed to provide annular rings of conductive material. The difference in sensing range between a disc and a ring of the same diameter is minimal as the flux lines affected by a disc and a ring are similar when either is placed generally over the overlap area between the two coils beneath a discrete playing area. However, when only a portion of a ring is above the overlap area, the flux lines are less effected compared with a similarly placed piece having a disc in its base. Thus a change in the flux lines is clearly detected when two playing pieces having rings in their bases are placed close to each other on a discrete playing area.

Preferably the coils are wound so that each adjacent square has magnetic flux in opposite directions. This results in both low electromagnetic emission and low sensitivity to external fields. The two sets of coils are typically arranged at right angles to each other, the overlap of the coils being symmetrical within each square.

The electronics required to provide the high frequency current to the coils preferably comprises a drive oscillator, an Automatic Level Control (ALC) to stabilise the amplitude of the oscillations and a multiplexer to select the transmit coil to which the current is to be supplied.

The electronics required to detect and compare the voltage of the receive coils with the reference voltage preferably comprises a multiplexer to select the receive coil, a preamplifier, a synchronous detector, an integrator and a comparator. The preamplifier amplifies the difference between the selected receive coil voltage and the reference voltage. Suitably an offset digital to analogue converter (D-A) provides an adjustable fraction of the high frequency drive signal to the receive circuits, to act as a reference. As noted above, the reference is normally the voltage measured for each square when no playing pieces are present on the board, but alternatively it may be a fixed voltage. If a measured reference is used, the offset D-A setting that just compensates the coupling factor, is found and saved for each square, by using a successive approximation algorithm and by examining the comparator output. In use, again for each of the squares in turn, the corresponding offset D-A setting saved previously is applied to the reference input of the preamplifier. The comparator output will indicate the presence or absence of a piece and also, if different materials are used in the bases of different types of pieces, the type of piece.

It is desirable to provide an additional offset to the measured reference voltage, so that a piece is only detected once the induced voltage in the receive coils exceeds the off-set voltage reference. This allows for any fluctuations which may occur within the system, when a piece is not present on the playing square, and reduces the possibility of false detection of a piece. This additional offset to the value applied to the offset D-A sets the sensing range of the system.

If the apparatus is to distinguish between the pieces, it is preferable to provide two offset reference voltages, preferably one above and one below the reference voltage measured when no pieces are present on the board. This means for a piece of one type to be detected, the induced voltage has to rise above the higher offset reference voltage, and for a piece of a different type to be detected, the induced voltage has to fall below the lower off-set reference voltage.

In the operation of the preferred embodiment of the invention the oscillator supplies the drive current, via a multiplexer, to a selected transmit coil. One of the receive coils, selected by a receive multiplexer, is connected to the preamplifier. The preamplifier amplifies and filters the difference between the receive coil voltage and a variable reference provided by the offset D-A, and the signal is then fed to the synchronous detector where it is multiplied by a reference signal from the oscillator. An imbalance current is produced and its sign is determined using an integrator and comparator. The sign of the imbalance current will depend upon the material in the base of the playing piece. For example, if a disc of aluminium is used, the imbalance current will be of one sign whereas if a ferrite disc is used, the imbalance current will be of the opposite sign. If no piece is present no significant imbalance current is produced.

Since a synchronous detector is used, the sensitivity bandwidth of the measuring circuit is accurately centred on the oscillator frequency. The noise bandwidth is determined by the integration time of the integrator. The effects of sensitivity of the synchronous detector to out of band signals (e.g. harmonics of the oscillator frequency) are minimized by the tuned circuit in the preamplifier.

In order to increase the drive current supplied, without significant increase in the power consumed, each transmit coil may have an associated tuned circuit or may have an individual transformer in order to match the impedances of the drive current supply circuit and the transmit coil.

The drive oscillator may comprise a number of transformers that are used to provide a large, sine-wave drive current to the transmit coils. Alternatively, discrete transistors or an integrated circuit may be used to achieve a high drive current whilst keeping the power consumption low. This latter embodiment does not provide a continuous sine-wave drive, but discrete current pulses that have the form of a half-cycle of a sine-wave. This is acceptable since it has adequate power at the frequencies of interest but does not cause excessive radiation.

If a pulsed drive current is used, it is necessary to offset the signal from the receive coils by a variable signal of opposite sign. Such a signal can be obtained by differentiating the current drive pulse and has the form of a full cycle of a sine wave. Further, this may be thresholded and used as a signal to sample the preamplifier output to give determination of the presence, absence or type of piece. Because of noise, one sample is inadequate for reliable sensing and an averaged result is needed. This can be achieved simply by counting the number of times a positive result is obtained against the number of negative results over a sampling period.

For this alternative system, many of the functions can be implemented digitally, even the provision of an offsetting signal. A variable dc signal may be used as a power source for a pulse generator circuit that synthesises the offset signal with a similar waveshape to that of the receive signal, but of amplitude determined by the dc voltage. Such an adjustable dc voltage may be provided by conventional means. All of the digital functions may be implemented on a single IC, which may result in a less expensive apparatus.

BRIEF DESCRIPTION OF THE DRAWINGS

FIG. 5 shows another embodiment of a winding frame;

FIG. 6 shows detail of the winding frame of FIG. 5;

DETAILED DESCRIPTION OF INVENTION

Figure 1:
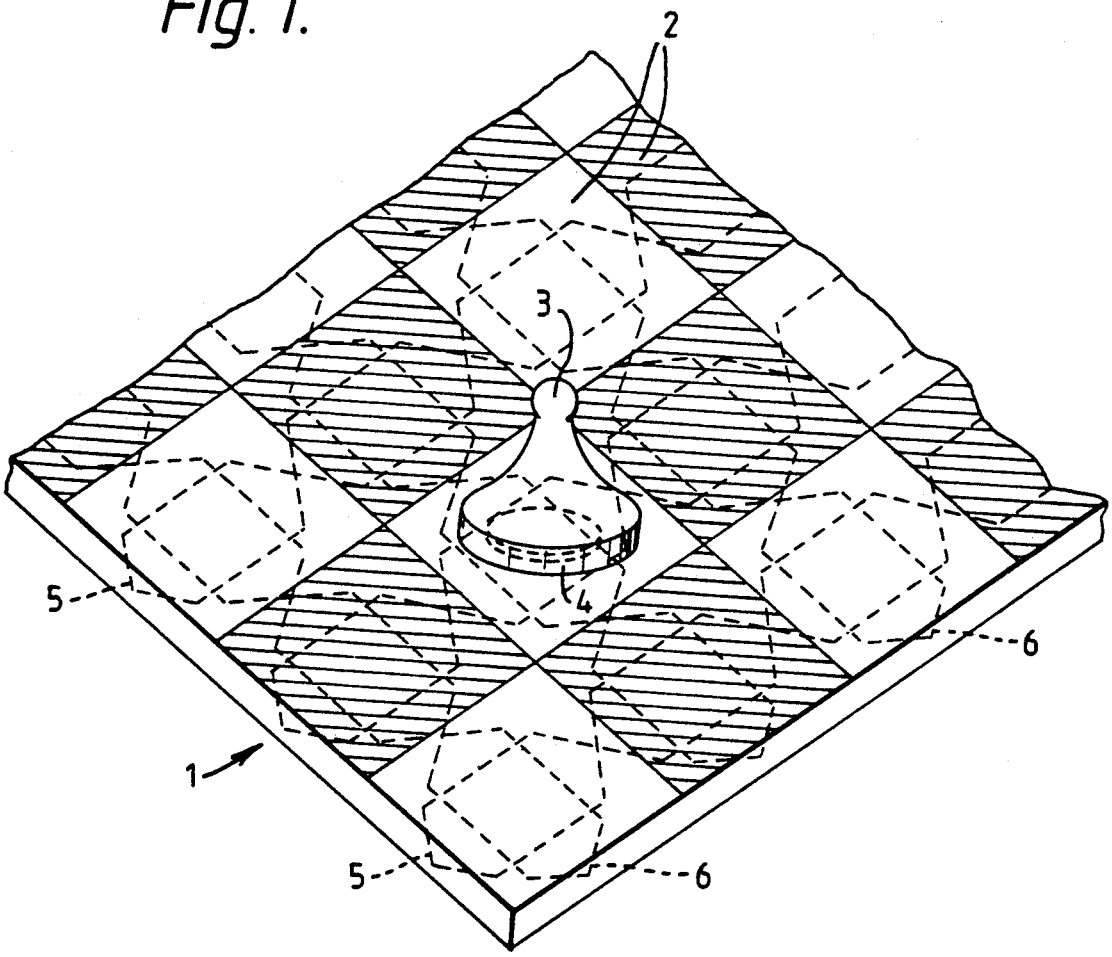
FIG. 1 is a perspective partial view of a game embodying the invention.

As shown in FIG. 1 a sensory game has a playing board 1, the surface of which is provided with a number of defined playing areas 2, for example the squares on a chess or draughts board, and a number of playing pieces 3, the bases of which are provided with an element 4. All the playing pieces of the apparatus may have a disc of the same type of material in their base, for example aluminium, or playing pieces of different types may have different materials in their bases, for example in the game of Chess, black pieces may be provided with a disc of aluminium whilst the white pieces have a disc of ferrite in their bases.

A matrix of coils 5,6 is provided close to the surface of the board 1, the coils being arranged so that each adjacent square 2 is wound in opposite directions. The conductors from one set of coils, the transmit coils 5 should not run alongside the conductors from the other set of coils, the receive coils 6.

Figure 2:
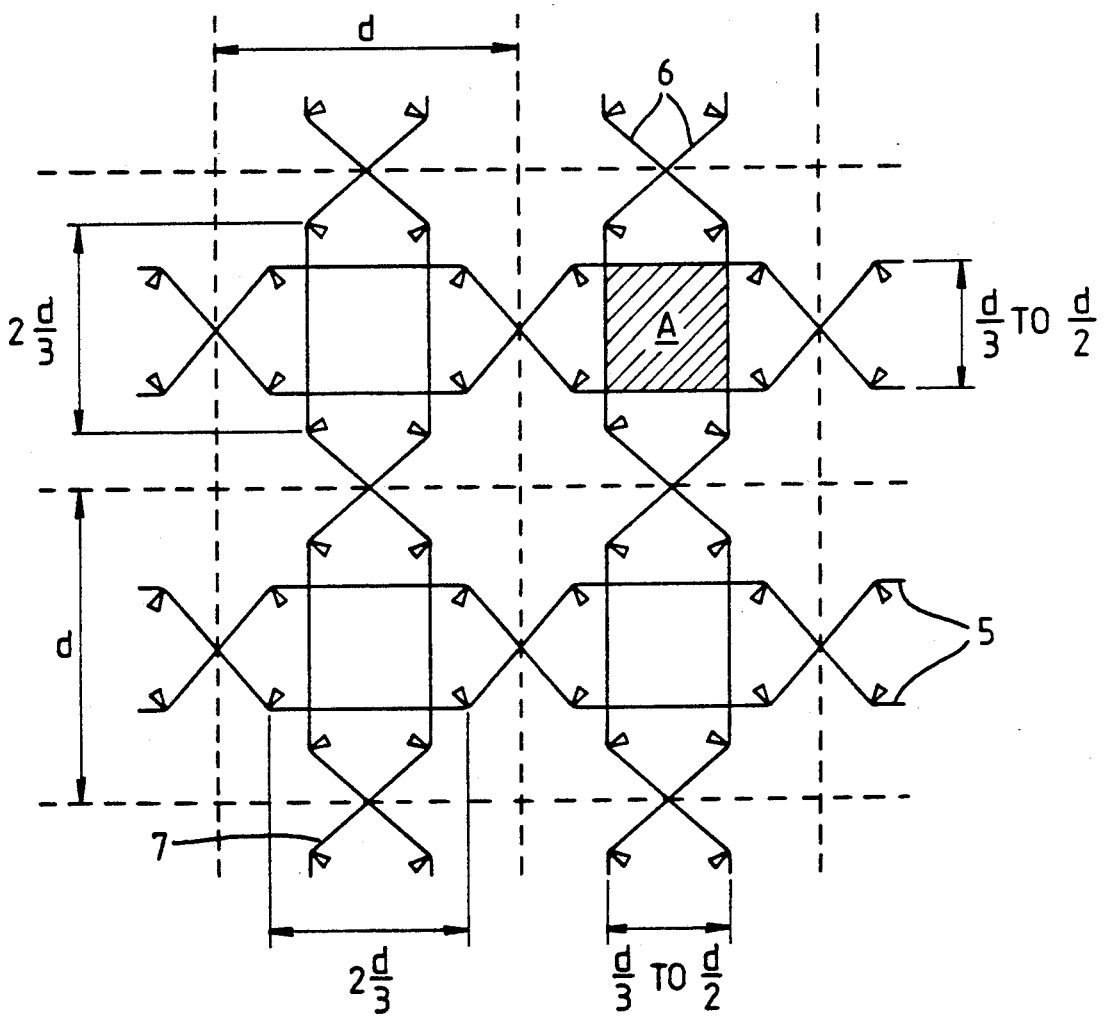
FIG. 2 shows detail of the winding and dimensions of the coils.

A suitable winding pattern for the coils is shown in FIG. 2. The optimum area of overlap A of a transmit coil 5 and a receive coil 6 is 1/9–¼ of the area of a playing area 2. In the case of a square playing area, the side of the overlap is ⅓-½ of the width of the square.

During construction of the game board 1, it is necessary to hold the wires in their correct lateral positions and also as close to the playing surface as possible. Winding of the wire can be done either by hand or machine.

FIG. 2 shows one embodiment in which the coils 5,6 are formed by winding a wire 7 around the pins of a jig. The wire is then laminated between two adhesive covered sheets (not shown) and the whole assembly removed from the pin jig.

This method achieves both lateral position precision, owing to the pin jig and vertical precision from the laminating process. The component cost is low but the sheet handling and laminating is difficult to automate.

Figure 3:
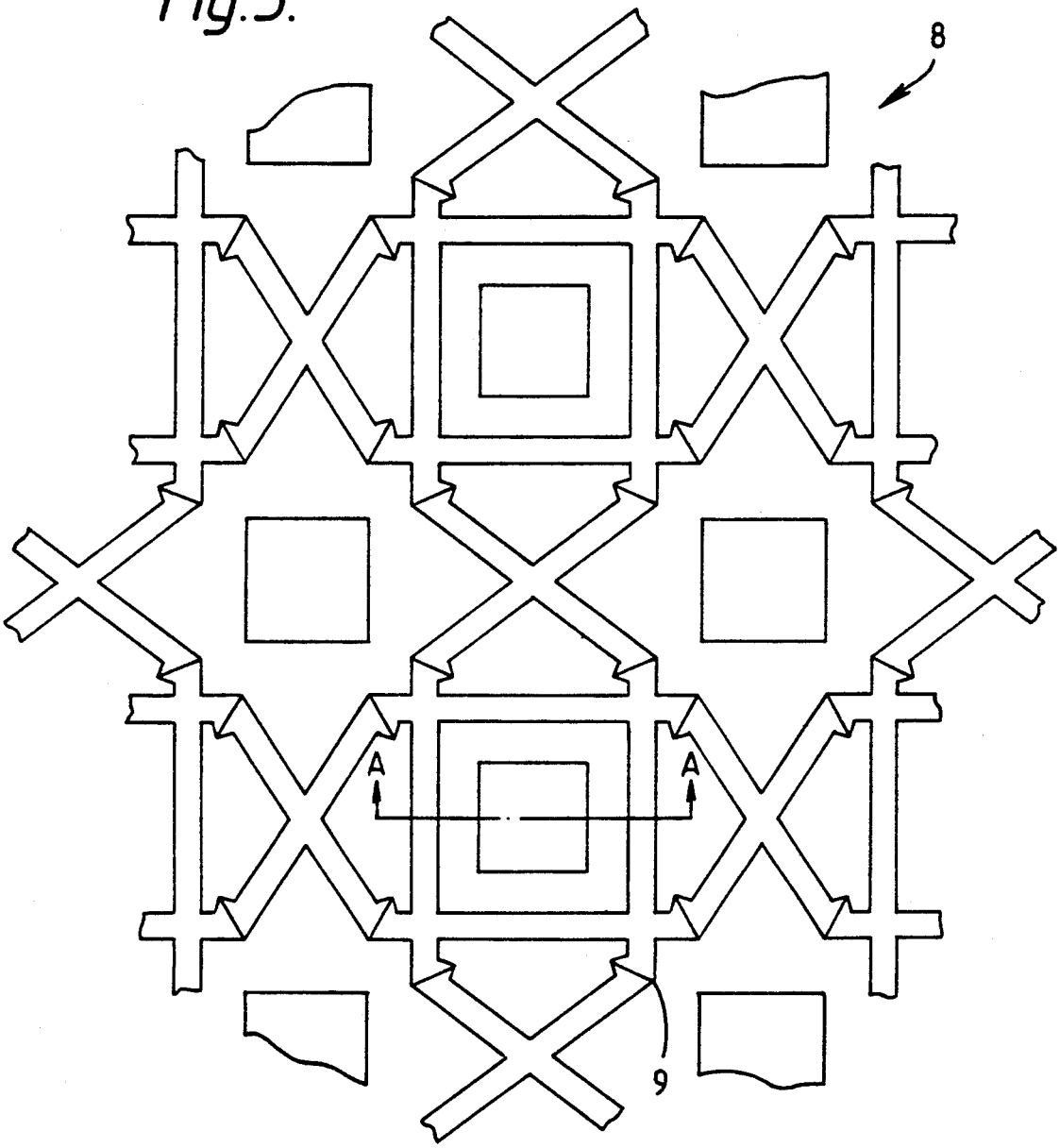
FIG. 3 shows one embodiment of a winding frame.
Figure 3A:
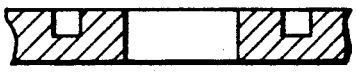
FIG. 3A is a section on the line A—A of FIG. 3.
Figure 4:
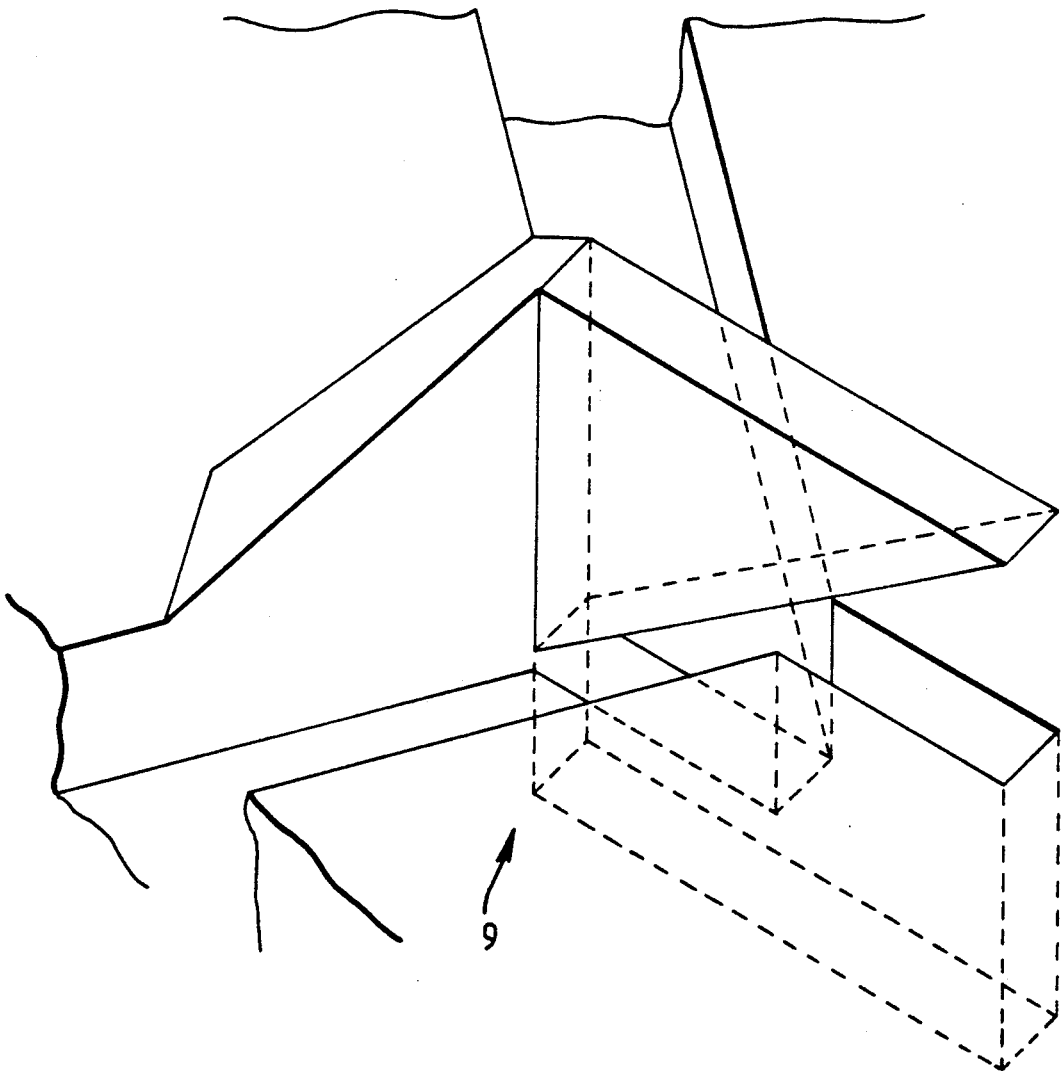
FIG. 4 shows detail of the winding frame of FIG. 3.

An alternative method is to mould or fabricate a winding frame 8 that has features 9 around which the wire can be wound (see FIG. 3). After it is wound, the frame 8 can be incorporated into the playing board of the game. A wire termination i.e. a connector to the main PCB, may be made as part of the frame.

A cheaper alternative is to fabricate a winding frame from plastic sheet, for example 300 micron polypropylene. Referring to FIGS. 5 and 6 a frame 10 is made by punching a pattern of tabs 11 in a sheet of plastic 12. The tabs are then formed, using either pressure alone or together with heat, to bring them out of the plane of the sheet 12. Once formed the tabs 11 act as winding features. The wire 13 is laid close to the surface of the sheet 12 and is pulled tightly around each tab in order to hold the wire securely in both the lateral and the vertical directions.

Figure 7:
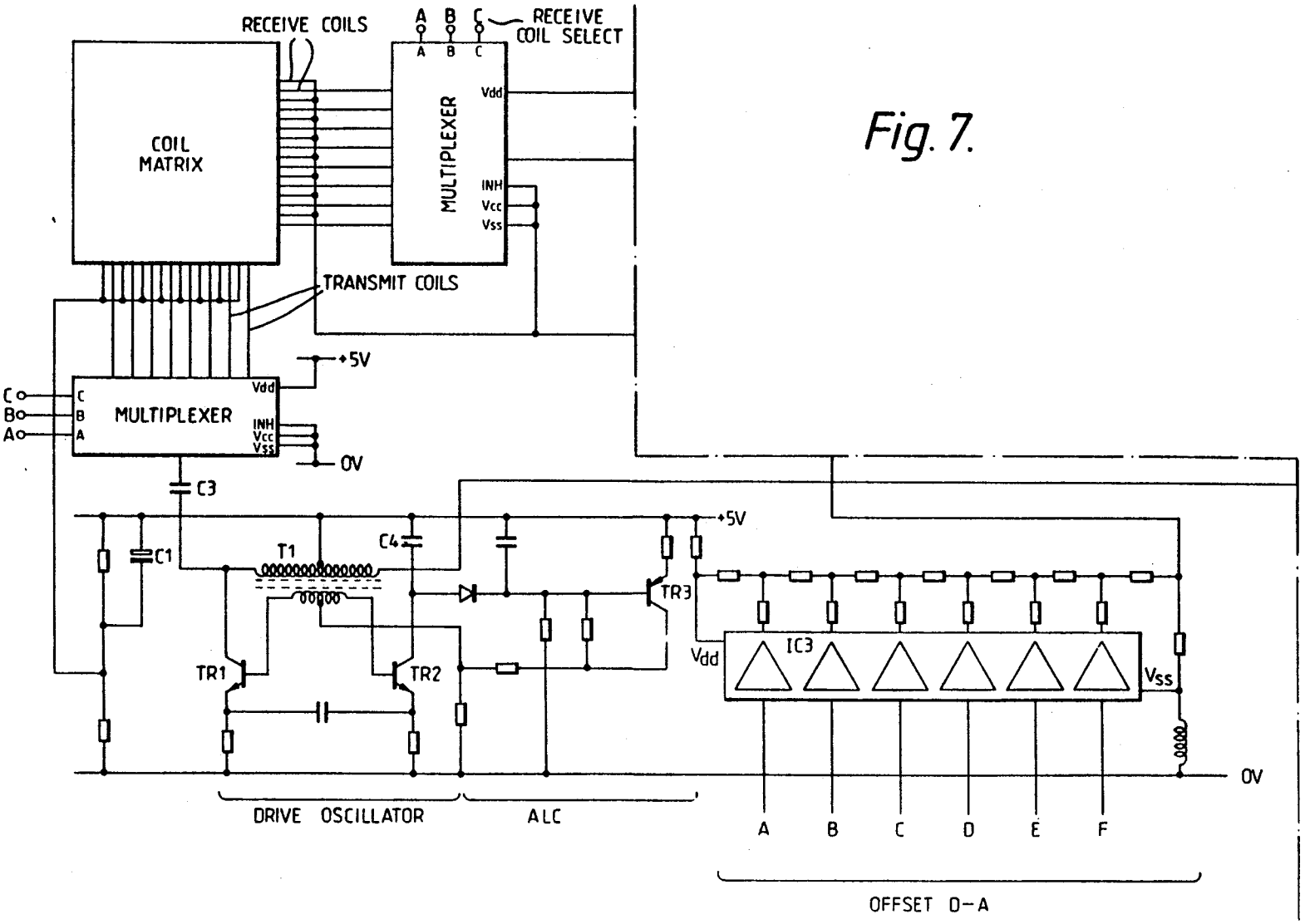
FIG. 7 is an electronic circuit suitable for use with the invention.
Figure 7:
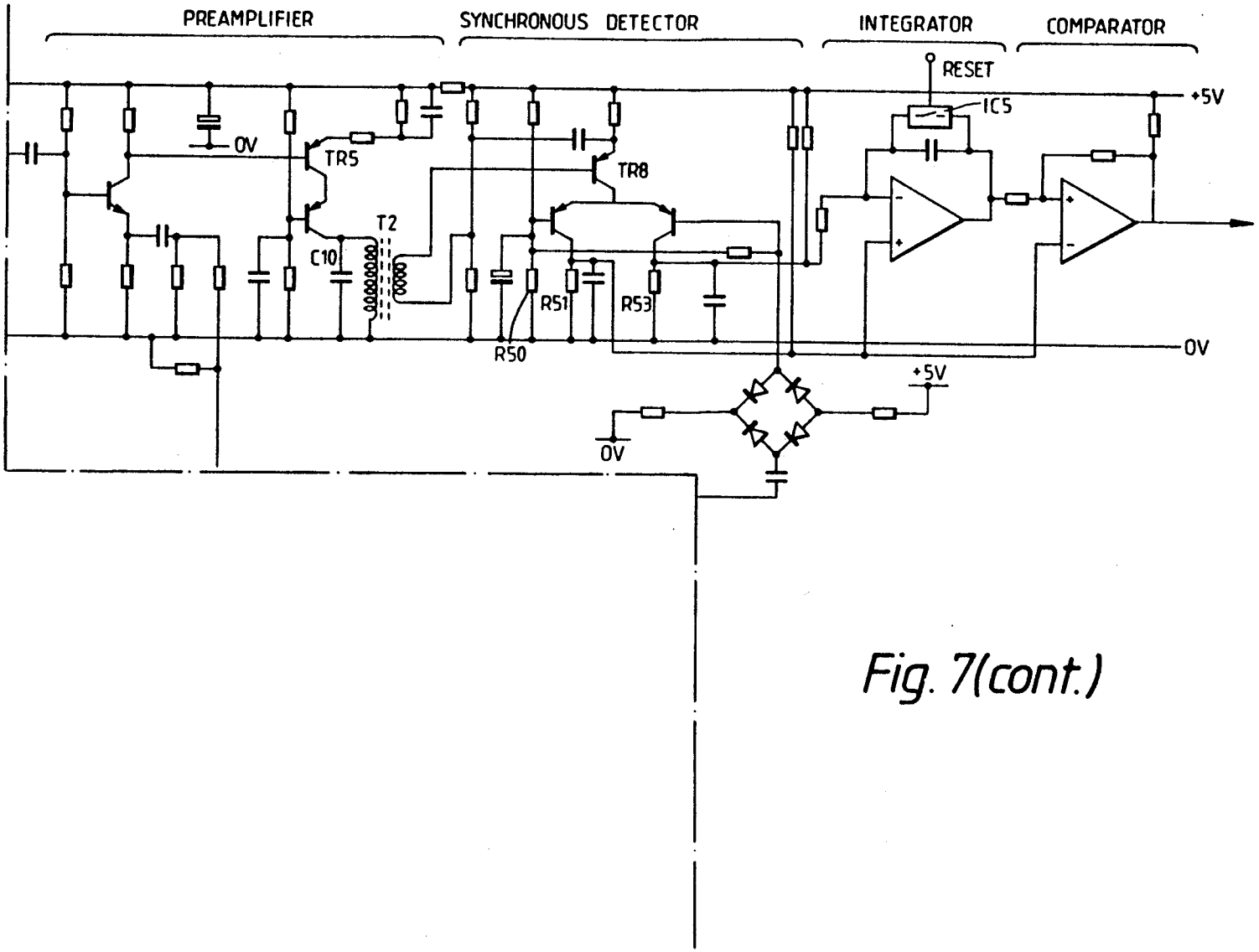

FIG. 7 shows the electronics necessary for analyzing the results from the game board and will now be described further.

The drive oscillator 14 provides a maximum low distortion AC drive current to the transmit coils 5 by using a tuned drive where the major power loss is in the multiplexer 15 resistance. A tuned circuit 16 is formed from T1 primary, C3 and C4. The circuit through C3 is completed via the multiplexer, the selected transmit coil and C1. A feedback winding on T1 alternately cuts off TR1 and TR2, causing oscillation. These transistors are a differential pair with AC emitter coupling to guarantee startup. The current through the transistors is determined by the Automatic Level Control (ALC) circuit around TR3 which stabilises the oscillation amplitude.

The offset D-A 16 has a series of CMOS gates, IC3, which have a small AC voltage applied to their Vss pin, but none to their Vdd pin. Their outputs connect to a R-2R ladder so that as they change, not only is there a corresponding DC voltage at the output of the ladder, but also an AC signal whose amplitude varies accordingly. The ladder output is added to a fixed proportion of the Vss signal to give an offset signal adjustable by about ±20% of nominal. If the apparatus is to distinguish between playing pieces, by virtue of the different effect of different metals in the bases of the playing pieces, two offset signals are needed, adjusted by about +20% or −20% of nominal respectively. This range compensates for variations in the coil coupling resulting from manufacturing tolerances and the movement of batteries under the playing surface.

The input transistor TR4 of the preamplifier 17 is used in a differential mode, amplifying the difference between the coil signal and that from the offset D-A. Further amplification and filtering is done by TR5 and T2 primary with C10. This tuned circuit operates a moderate Q (about 20), determined by the input impedance of TR8. It rejects most low and high frequency noise.

The synchronous detector is a conventional arrangement using a commutating emitter coupled pair to divert the signal current from TR8 into alternate load resistors R51 and R53. The reference signal comes from the oscillator so the output corresponds to the in-phase component of the received signal, a positive or negative imbalance current being produced depending on the sign of the in-phase component of the input signal. The detector 18 is sensitive to input signals at the harmonics of this reference signal, but these are removed by the tuned circuit in the preamplifier 17.

The imbalance current from the detector is then applied to a conventional integrator 19. After the AC signal conditions have stabilised, the integrator 19 output ramps according to the sign of the imbalance current. After an appropriate delay to allow for averaging of noise signals, the sign of the integrator 19 outputs shows the comparison of the induced voltage against the offset D-A setting. The sign will depend upon the material present in the base of the playing pieces and the apparatus can therefore be used either merely to detect the presence of a playing piece on a playing square or, as described previously, distinguish between types of playing pieces on a playing square, one type of playing piece producing a positive output from the integrator and one type of playing piece resulting in a negative output. The integrator 19 reference voltage varies with the voltage at R50, so it is necessary to apply it to the comparator 20 reference as well. A reset switch K5 is provided for the comparator to remove the capacitor charge resulting from the previous measurement. This is not essential but does speed up the measurement.

The game is operated in two modes, reference and run. In the reference mode each of the chess squares are selected in turn by the multiplexers. For each square, using a successive approximation algorithm and by examining the comparator output, the offset D-A setting that just compensates the coupling factor is found and saved. In run mode, again for each of the squares in turn, the corresponding offset D-A setting measured during the reference mode, together with an additional offset, is applied to the preamplifier 17. The comparator 20 output thus indicates the presence or absence of a piece, and the type of playing piece if desired. Reference mode can optionally be subsumed by factory settings, leaving the end user with run mode only.

We claim:

1. An electronic game apparatus comprising; a board having discrete playing areas, a plurality of playing pieces, a plurality of transmit and receive coils arranged beneath the board, the playing pieces having an element, a supply means for supplying a current to the transmit coils to induce a voltage in the receive coils, and a comparison means for comparing the voltage with a reference voltage.

2. Apparatus according to claim 1 wherein the element of the playing pieces is comprised of metal.

3. Apparatus according to claim 1 wherein the playing pieces are comprised of first and second sets of playing pieces, the element of the first set comprising a material having a first conductivity and the element of the second set comprising a material having a second conductivity.

4. Apparatus according to claim 3 wherein the element of the first set comprises metal and the element of the second set comprises a material selected from the group of ferrite and finely divided ferromagnetic material.

5. Apparatus according to claim 1 wherein the reference voltage is the voltage in the receive coils, for each discrete playing area, in the absence of a playing piece.

6. Apparatus according to claim 1 wherein an offset is added to the reference voltage to avoid spurious detection responses.

7. Apparatus according to claim 1 wherein the supply means comprises an oscillator and a multiplexer to select the transmit coil to which the current is supplied.

8. Apparatus according to claim 1 in which the comparison means comprises a multiplexer to select the receive coil, a preamplifier to amplify the difference between the two voltages, a synchronous detector, an integrator and a comparator.

9. Apparatus according to claim 1 in which the transmit coils have a tuned circuit to match the impedances of a drive current supply circuit and the transmit coils.

10. Apparatus according to claim 1 wherein the transmit and receive coils are substantially parallel to the board and substantially perpendicular to each other.

* * * * *